US009285767B2

(12) United States Patent
Seong et al.

(10) Patent No.: US 9,285,767 B2
(45) Date of Patent: Mar. 15, 2016

(54) IMAGE FORMING APPARATUS

(71) Applicant: Samsung Electronics Co., Ltd, Suwon-si, Gyeonggi-do (KR)

(72) Inventors: Jeong-jae Seong, Namyangju-si (KR); Jin-ho Park, Yongin-si (KR); Young-min Yoon, Suwon-si (KR); Byung-jo Lee, Bucheon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/313,023

(22) Filed: Jun. 24, 2014

(65) Prior Publication Data

US 2015/0160609 A1 Jun. 11, 2015

(30) Foreign Application Priority Data

Dec. 9, 2013 (KR) ..... 10-2013-0152234

(51) Int. Cl.
*G03G 15/00* (2006.01)
*G03G 21/20* (2006.01)

(52) U.S. Cl.
CPC ..... *G03G 21/203* (2013.01); *G03G 21/206* (2013.01)

(58) Field of Classification Search
CPC . G03G 21/20; G03G 21/203; G03G 15/2078; G03G 2215/00772
USPC ..... 399/44, 94, 97
See application file for complete search history.

(56) References Cited

U.S. PATENT DOCUMENTS

| | | | | |
|---|---|---|---|---|
| 2006/0222385 | A1* | 10/2006 | Serita | 399/44 |
| 2009/0304041 | A1* | 12/2009 | Streicher et al. | 374/28 |
| 2010/0061756 | A1 | 3/2010 | Bisset | |
| 2012/0162343 | A1* | 6/2012 | Fujishiro | 347/225 |
| 2014/0210928 | A1* | 7/2014 | Yokoi | 347/118 |

FOREIGN PATENT DOCUMENTS

| | | |
|---|---|---|
| JP | 09-292820 | 11/1997 |
| JP | 11-038861 | 2/1999 |
| JP | 2933432 | 5/1999 |
| JP | 11-249534 | 9/1999 |
| JP | 2002-357965 | 12/2002 |
| JP | 2003-098938 | 4/2003 |
| JP | 2004-013015 | 1/2004 |
| JP | 2009-204935 | 9/2009 |
| JP | 2010-122332 | 6/2010 |
| KR | 10-2005-0041162 | 5/2005 |

OTHER PUBLICATIONS

European Search Report dated Apr. 24, 2015 issued in corresponding European Patent Application 14177237.6.

* cited by examiner

*Primary Examiner* — Walter L Lindsay, Jr.
*Assistant Examiner* — Jessica L Eley
(74) *Attorney, Agent, or Firm* — Staas & Halsey LLP

(57) ABSTRACT

An image forming apparatus includes a main body having a fusing unit, a first temperature sensor which is disposed in an external surface of the main body and measures an outside temperature, a humidity sensor which is disposed in the external surface of the main body and measures an outside humidity, a second temperature sensor which is disposed inside the main body and measures an inside temperature, at least one fan disposed in the main body, and a controller configured to calculate a dew point temperature using the inside temperature and the outside humidity and operate the at least one fan based on the calculated dew point temperature.

15 Claims, 8 Drawing Sheets

IMAGE FORMING APPARATUS

CROSS-REFERENCE TO RELATED APPLICATIONS

This application claims priority under 35 U.S.C. §119(a) from Korean Patent Application No. 10-2013-0152234 filed Dec. 9, 2013 in the Korean Intellectual Property Office, the disclosure of which is incorporated herein by reference in its entirety.

BACKGROUND OF THE INVENTION

1. Field of the Invention

The present general inventive concept relates to an image forming apparatus. More particularly, the present general inventive concept relates to an image forming apparatus that can prevent dew condensation from occurring.

2. Description of the Related Art

In general, an image forming apparatus, such as a laser printer, is provided with a fusing device that fixes a toner image formed on a print medium. The fusing device fixes the toner image onto the print medium by applying heat and pressure.

If the image forming apparatus is placed in an environment in which dew condenses out of the air, hot air that is heated by the heat of the fusing device meets cold air around the fusing device and may cause dew to form on peripheral parts (e.g., conveying rollers or paper discharging rollers). Therefore, a phenomenon may occur in which a print medium to which dew is stuck is discharged outside the image forming apparatus.

This phenomenon may degrade the quality of printing. Therefore, various methods of preventing such phenomenon have been attempted. However, most of the conventional methods do not prevent dew condensation in advance, but instead take an action to block the phenomenon after the dew condensation has already occurred.

If such conventional methods are applied, dew is stuck to the print media that have already been printed before the environment of the dew condensation disappears, and thus the print media stained with the dew are still discharged outside the image forming apparatus.

SUMMARY OF THE INVENTION

The present general inventive concept provides an image forming apparatus that can prevent a dew condensation phenomenon before a print work is started by predicting in advance a likelihood of occurrence of dew condensation.

Additional features and utilities of the present general inventive concept will be set forth in part in the description which follows and, in part, will be obvious from the description, or may be learned by practice of the general inventive concept.

Exemplary embodiments of the present general inventive concept provide an image forming apparatus including a main body having a fusing unit, a first temperature sensor which is disposed in an external surface of the main body and measures an outside temperature, a humidity sensor which is disposed in the external surface of the main body and measures an outside humidity, a second temperature sensor which is disposed inside the main body and measures an inside temperature, at least one fan disposed in the main body, and a controller configured to calculate a dew point temperature by using the inside temperature and the outside humidity and operate the at least one fan based on the calculated dew point temperature. The controller may compare a temperature difference between the outside temperature and the inside temperature to a preset temperature margin, and, if the temperature difference is equal to or less than the preset temperature margin, the controller may calculate the dew point temperature.

The controller may compare the outside temperature to the dew point temperature, and, if a difference between the outside temperature and the dew point temperature is equal to or less than the preset temperature margin, the controller may operate the at least one fan.

The preset temperature margin may be 3° C. or more.

The second temperature sensor may be disposed above the fusing unit.

The second temperature sensor may be disposed adjacent to a portion of a paper conveying path which is disposed downstream of the fusing unit.

The controller may calculate the dew point temperature by using a Magnus formula.

Exemplary embodiments of the present general inventive concept also provide an image forming apparatus including a main body having a fusing unit, a first temperature sensor which is disposed in an external surface of the main body and measures an outside temperature, a second temperature sensor which is disposed inside the main body and measures an inside temperature, a humidity sensor which is disposed inside the main body and measures an inside humidity, at least one fan disposed in the main body, and a controller configured to calculate a dew point temperature by using the inside temperature and the inside humidity and operate the at least one fan based on the calculated dew point temperature. The controller may compare a temperature difference between the outside temperature and the inside temperature to a preset temperature margin, and, if the temperature difference is equal to or less than the preset temperature margin, the controller may calculate the dew point temperature.

The controller may compare the outside temperature to the dew point temperature, and, if a difference between the outside temperature and the dew point temperature is equal to or less than the preset temperature margin, the controller may operate the at least one fan.

The preset temperature margin may be 3° C. or more.

The second temperature sensor and the humidity sensor may be disposed above the fusing unit.

The second temperature sensor and the humidity sensor may be disposed adjacent to a portion of a paper conveying path which is disposed downstream of the fusing unit.

Exemplary embodiments of the present general inventive concept also provide an image forming apparatus including a main body, a first temperature sensor to measure an outside temperature corresponding to an air temperature outside of the main body, a humidity sensor to measure a humidity, a second temperature sensor to measure an inside temperature corresponding to an air temperature inside of the main body, a cooling unit disposed in the main body, and a controller configured to calculate a dew point temperature using the inside temperature and the humidity, and to operate the cooling unit based on a difference between the outside temperature and the calculated dew point temperature.

The controller may calculate the dew pointe temperature when a difference between the inside temperature and the outside temperature is less than or equal to a first predetermined temperature margin.

The controller may operate the cooling unit if the difference between the outside temperature and the calculated dew point temperature is less than or equal to a second predetermined temperature margin.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE EMBODIMENTS

Figure 1:
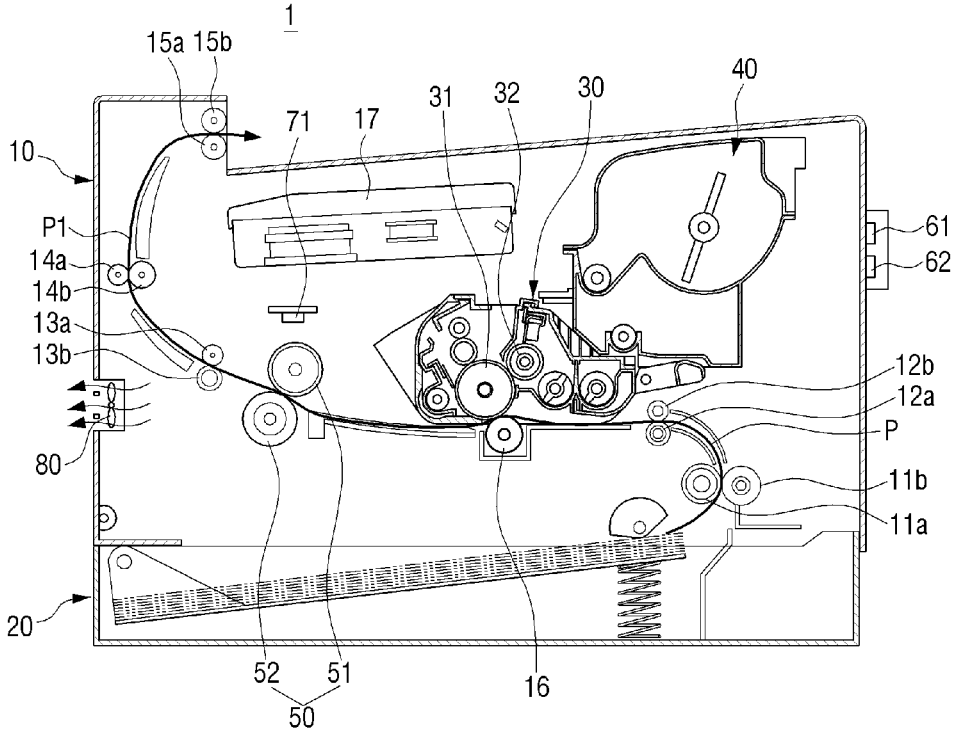
FIG. 1 is a view schematically illustrating an image forming apparatus according to an exemplary embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

The matters defined herein, such as a detailed construction and elements thereof, are provided to assist in a comprehensive understanding of this description. Thus, it is apparent that exemplary embodiments may be carried out without those defined matters. Also, well-known functions or constructions are omitted to provide a clear and concise description of exemplary embodiments. Further, dimensions of various elements in the accompanying drawings may be arbitrarily increased or decreased to assist in a comprehensive understanding.

Figure 2:
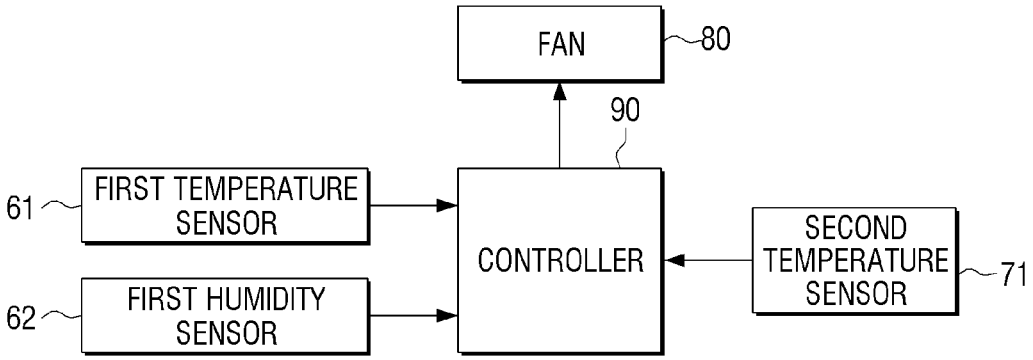
FIG. 2 is a block diagram illustrating a configuration provided in the image forming apparatus of FIG. 1 in order to prevent dew condensation.
Figure 3:
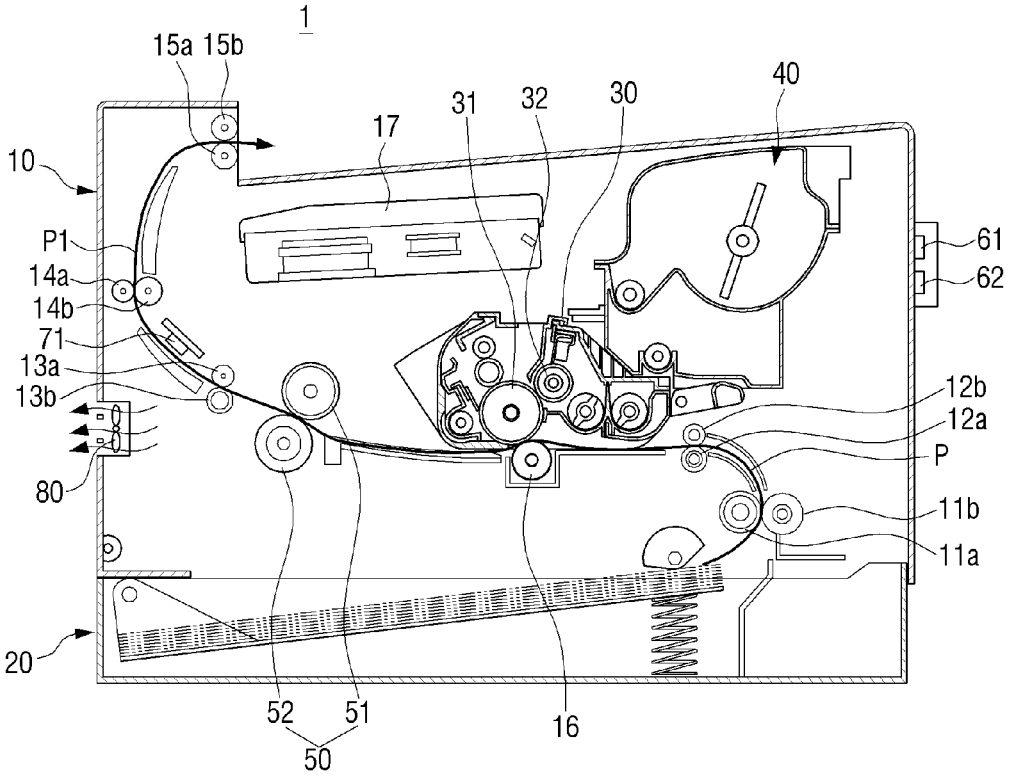
FIG. 3 is a view illustrating an alternative arrangement of a second temperature sensor provided in the image forming apparatus of FIG. 1.

FIG. 1 is a view schematically illustrating an image forming apparatus 1 according to an exemplary embodiment of the present general inventive concept, and FIG. 2 is a block diagram illustrating a configuration provided in the image forming apparatus 1 of FIG. 1 in order to prevent dew condensation. FIG. 3 is a view illustrating an alternative arrangement of a second temperature sensor 71 provided in the image forming apparatus 1 of FIG. 1.

In this exemplary embodiment, an image forming apparatus 1 is implemented as a laser printer. However, the technical idea of the present general inventive concept may not be limited to the laser printer, but may equally be applied to other image forming apparatuses adopting the electro-photographic printing method, such as copy machines, facsimile machines, multifunctional products, etc.

Referring to FIG. 1, the image forming apparatus 1 includes a main body 10, and a paper feeding unit 20 which is detachably disposed in a lower portion of the main body 10. The paper feeding unit 20 accommodates a number of print media to be printed. Printing is performed on print media which are picked-up from the paper feeding unit 20 within the main body 10.

Referring to FIG. 1, an exposure unit 17, a developing unit 30, a toner supplying unit 40, a transfer roller 16, and a fusing unit 50 are equipped inside the main body 10 of the image forming apparatus 1.

The developing unit 30 includes a photosensitive medium 31 and a developing roller 32. An electrostatic latent image reflecting printing data is formed on a surface of the photosensitive medium 31 by laser being emitted from the exposure unit 17. The electrostatic latent image is developed into a toner image by the developing roller 32. When a print medium passes through a nip formed between the photosensitive medium 31 and the transfer roller 16, the toner image formed on the photosensitive medium 31 is transferred onto the print medium. The toner supplying unit 40 supplies the developing unit 30 with toner which is stored inside the toner supplying unit 40. The fusing unit 50 includes a heat roller 51 and a pressure roller 52, and causes the transferred toner image to be fixed onto the print medium by applying heat and pressure.

Referring to FIG. 1, conveying rollers 11*a*, 11*b*, 12*a*, 12*b*, 13*a*, 13*b*, 14*a*, and 14*b* and paper discharging rollers 15*a* and 15*b* are also provided inside the main body 10 of the image forming apparatus 1. The conveying rollers 11*a*, 11*b*, 12*a*, 12*b*, 13*a*, 13*b*, 14*a*, and 14*b* convey print media picked-up from the paper feeding unit 20 along a paper conveying path P. FIG. 1 illustrates four pairs of conveying rollers 11*a*, 11*b*, 12*a*, 12*b*, 13*a*, 13*b*, 14*a*, and 14*b*, but the number and arrangement of the conveying rollers may be variously changed. The paper discharging rollers 15*a* and 15*b* discharge print media of which the printing process is finished outside the main body 10.

In initial operation of the image forming apparatus 1, high-temperature air which is generated around the fusing unit 50 encounters low-temperature air which already resides inside the image forming apparatus 1 so that dew condensation may occur. When the dew condensation occurs, dew which forms on the peripheral parts (e.g. the conveying rollers 13*a*, 13*b*, 14*a*, and 14*b* or paper discharging rollers 15*a* and 15*b*) that are disposed in the paper conveying path P may be stuck to the print medium, thereby deteriorating the quality of the printed image.

Referring to FIGS. 1 and 2, in order to prevent in advance the above-described dew condensation phenomenon the image forming apparatus 1 also includes a first temperature sensor 61, a first humidity sensor 62, a second temperature sensor 71, a fan 80, and a controller 90 which are equipped in the main body 10.

The first temperature sensor 61 and the first humidity sensor 62 are disposed in an external surface of the main body 10 of the image forming apparatus 1, and measure outside temperature and outside humidity, respectively. The outside temperature and outside humidity that are measured by the first temperature sensor 61 and the first humidity sensor 62 are transmitted to the controller 90.

The second temperature sensor 71 is disposed above and adjacent to the fusing unit 50. For the purposes of this exemplary embodiment, relative terms such as "above" and "below" are made with reference to FIGS. 1 and 3. As illustrated in FIG. 1, the second temperature sensor 71 may be disposed in a level higher than the nip which is formed between the heat roller 51 and the pressure roller 52. Alternatively, as illustrated in FIG. 3, the second temperature sensor 71 may be disposed adjacent to the portion P1 of the paper conveying path P which is disposed downstream of the fusing unit 50. The second temperature sensor 71 measures the temperature of the inside of the image forming apparatus 1. The measured inside temperature is transmitted to the controller 90.

The fan 80 prevents the inside of the image forming apparatus 1 from overheating by discharging hot air which is generated inside the image forming apparatus 1 to outside. As illustrated in FIG. 1, the fan 80 may be disposed as close as possible to the fusing unit 50 so that the hot air formed around the fusing unit 50 can be discharged to outside. FIG. 1 illustrates only one fan 80, but a plurality of fans, which performs the same function, may be provided in the main body 10 of the image forming apparatus 1. Furthermore, another type of cooling unit, for example an air conditioner (not illustrated), may be used in place of the fan 80.

The controller 90 controls not only a printing operation of the image forming apparatus 1, but also an operation of the fan 80 to prevent dew condensation from occurring in the image forming apparatus 1. Here, the control of the operation of the fan 80 to prevent the dew condensation in advance is performed based on measurement data which are provided from the first temperature sensor 61, the first humidity sensor 62, and the second temperature sensor 71.

Figure 4:
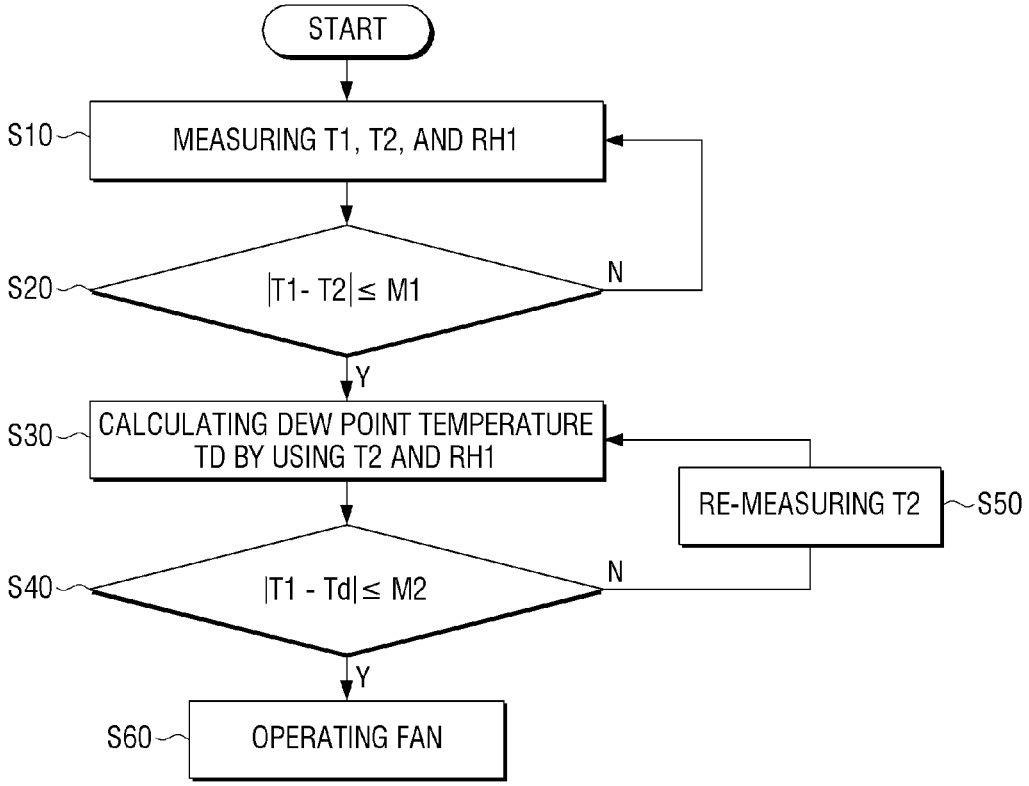
FIG. 4 is a flowchart illustrating a control of an operation of a fan that is performed by a controller of the image forming apparatus of FIG. 1.

The control of the operation of the fan 80 will be explained in detail with reference to FIG. 4. Here, FIG. 4 is a flowchart illustrating a control of an operation of a fan that is performed by a controller of the image forming apparatus of FIG. 1.

In an operation S10, the first temperature sensor 61, the first humidity sensor 62, and the second temperature sensor 71 respectively measure an outside temperature T1, an outside humidity RH1, and an inside temperature T2.

In an operation S20, difference between the outside temperature T1 and the inside temperature T2 (|T1−T2|) is compared to a preset first temperature margin M1. If the difference is equal to or less than the first temperature margin M1 (operation S20-Y), a next operation S30 is performed, and if the difference is larger than the first temperature margin M1 (operation S20-N), the process returns to the operation S10. For example, the first temperature margin M1 may be selected in the range of 3° C. or less.

Here, a case in which the difference between the outside temperature T1 and the inside temperature T2 is larger than the first temperature margin M1 means that the heat roller 51 of the fusing unit 50 is sufficiently heated, and thus the inside temperature T2 is higher than the first temperature margin M1 as compared to the outside temperature T1. If the heat roller 51 of the fusing unit 50 is sufficiently heated, there is already no risk of occurrence of the dew condensation in the image forming apparatus 1, so there is no need to perform the next operation.

On the other hand, a case in which the difference between the outside temperature T1 and the inside temperature T2 is equal to or less than the first temperature margin M1 means that the heat roller 51 of the fusing unit 50 is not sufficiently heated, and thus there is not a sufficient difference between the outside temperature T1 and the inside temperature T2 to prevent the occurrence of dew condensation in the image forming apparatus 1. The case commonly arises in the initial operation of the image forming apparatus 1, before the heat roller 51 has had time to reach a target temperature. Therefore, in the initial operation, while the heat roller 51 is being heated to the target temperature, dew condensation may occur inside the image forming apparatus 1. Accordingly, if the difference between the outside temperature T1 and the inside temperature T2 is equal to or less than the first temperature margin M1, the next operation (operation S30) is performed.

In an operation S30, a dew point temperature Td is calculated by substituting the measured inside temperature T2 and the measured outside humidity RH1 into a dew point calculation formula. The following known Magnus formula may be used as the dew point calculation formula.

$$T_d = \frac{b\left[\ln\left(\frac{RH}{100}\right) + \frac{aT}{b+T}\right]}{a - \ln\left(\frac{RH}{100}\right) - \frac{aT}{b+T}}$$

In the Magnus formula, Td is a dew point temperature of air, T is temperature of air, RH is relative humidity of air, and a and b are constant values set according to particular valuation sets, to maximize accuracy of the calculated dew point temperature Td within a given temperature range. For the purposes of this exemplary embodiment, these constants are a=12.271, and b=237.7. It will be understood that the values of these constants may be modified depending on the particular temperature range that the image forming apparatus 1 is expected to operate in.

Based off of the values of the constants a and b, the dew point temperature Td may be calculated with the Magnus formula. For example, if T2=T=30° C. and RH=80% are substituted into the formula, and the constant values of a=12.271 and b=237.7 are used, Td=24.6° C. is calculated.

In an operation S40, the outside temperature T1 measured in the operation S10 is compared to the dew point temperature Td calculated in the operation S30.

As a result of the comparison, if it is determined that the difference between the outside temperature T1 and the dew point temperature Td (|T1−Td|) is greater than a second temperature margin M2 (operation S40-N), the process proceeds to operation S50 in which the inside temperature T2 is remeasured, and then returns to the operation S30. In this case, the reason that the next operation S60 to prevent the dew condensation is not performed is because it is determined that the dew condensation is unlikely to occur since the outside temperature T1 is considerably higher than the dew point temperature Td.

Alternatively, as a result of the comparison, if it is determined that the difference between the outside temperature T1 and the dew point temperature Td is equal to or less than the second temperature margin M2 (operation S40-Y), the next operation S60 to prevent the dew condensation in advance is performed. In this case, the reason that the next operation S60 to prevent the dew condensation in advance is performed is because it is determined that occurrence of the dew condensation is imminent since the dew point temperature Td is so close to the outside temperature T1.

Here, for example, the second temperature margin M2 may be determined in the range of 3° C. or more. For example, the second temperature margin M2 may be set as 3° C., 4° C., 5° C., 6° C., etc. It should be considered that, if the second temperature margin M2 is set to a value that is too small, the dew condensation may occur already before the operation S60 to prevent the dew condensation is performed. On the other hand, it should also be considered that, if the second temperature margin M2 is set to a value that is too large, there is a drawback that operation S60 is performed for an excessively long time.

It will also be understood that the first temperature margin M1 may be the same as the second temperature margin M2.

That is, the difference |T1−T2| and the difference |T1−Td| may both be compared to the same temperature margin, which may be for example 3° C. or more.

In the operation S60, the fan 80 is operated to suppress the rise of the inside temperature T2. If the fan 80 is operated, the air around the fusing unit 50 is cooled, so that the rise of the inside temperature T2 that indicates temperature around the fusing unit 50 is suppressed. It will be understood that, based on the Magnus formula above, as the T value in the formula decreases, the dew point temperature Td calculated from the formula also decreases. Accordingly, if the fan 80 is operated and T2 is decreased, the rise of the dew point temperature Td is also suppressed so that the dew point temperature Td is prevented from reaching the outside temperature T1. When considering the fact that when the dew point temperature Td and the outside temperature T1 are equal, the dew condensation occurs, it can be understood that the occurrence of the dew condensation in the image forming apparatus 1 is prevented in advance by operating the fan 80 in the operation S60.

As described above, with the image forming apparatus 1 according to the above exemplary embodiment of the present general inventive concept, since the occurrence of the dew condensation is prevented in advance by predicting the likelihood that the dew condensation will occur inside the image forming apparatus 1, the phenomenon in which dew formed on the parts (e.g., the conveying rollers 11*a*-14*b* or the paper discharging rollers 15*a*, 15*b*) inside the image forming apparatus 1 is stuck onto and discharged with the print medium may be prevented. Accordingly, it can be prevented that print quality is degraded due to the occurrence of the dew condensation in the image forming apparatus 1.

Figure 5:
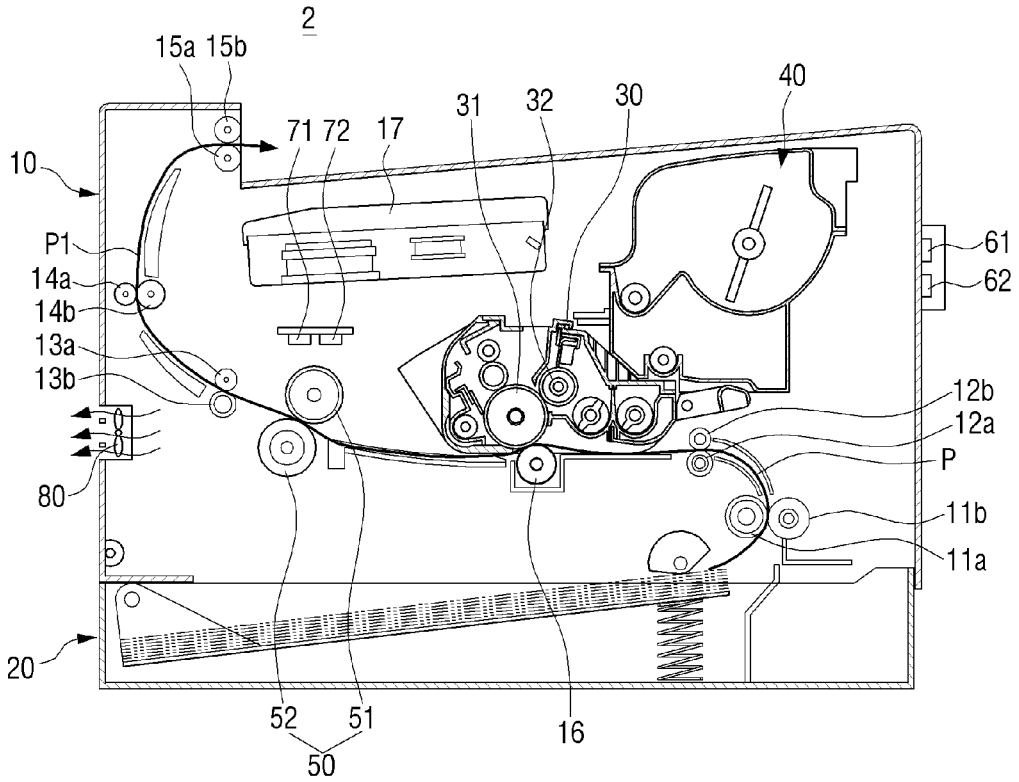
FIG. 5 is a view schematically illustrating an image forming apparatus according to an exemplary embodiment of the present general inventive concept.
Figure 6:
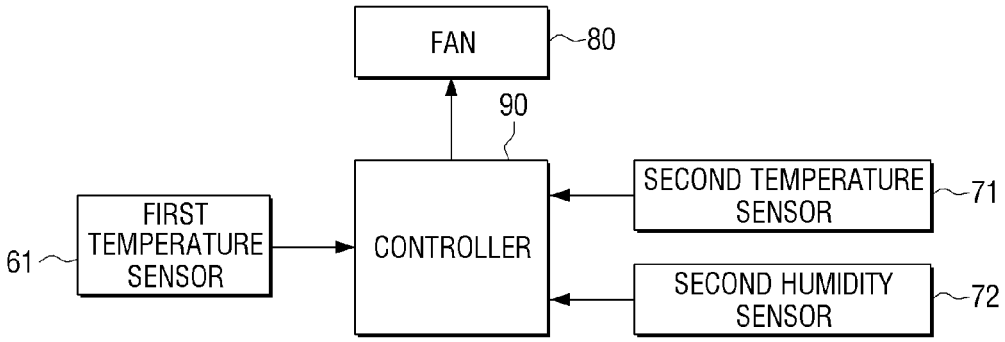
FIG. 6 is a block diagram illustrating a configuration provided in the image forming apparatus of FIG. 5 in order to prevent dew condensation.
Figure 7:
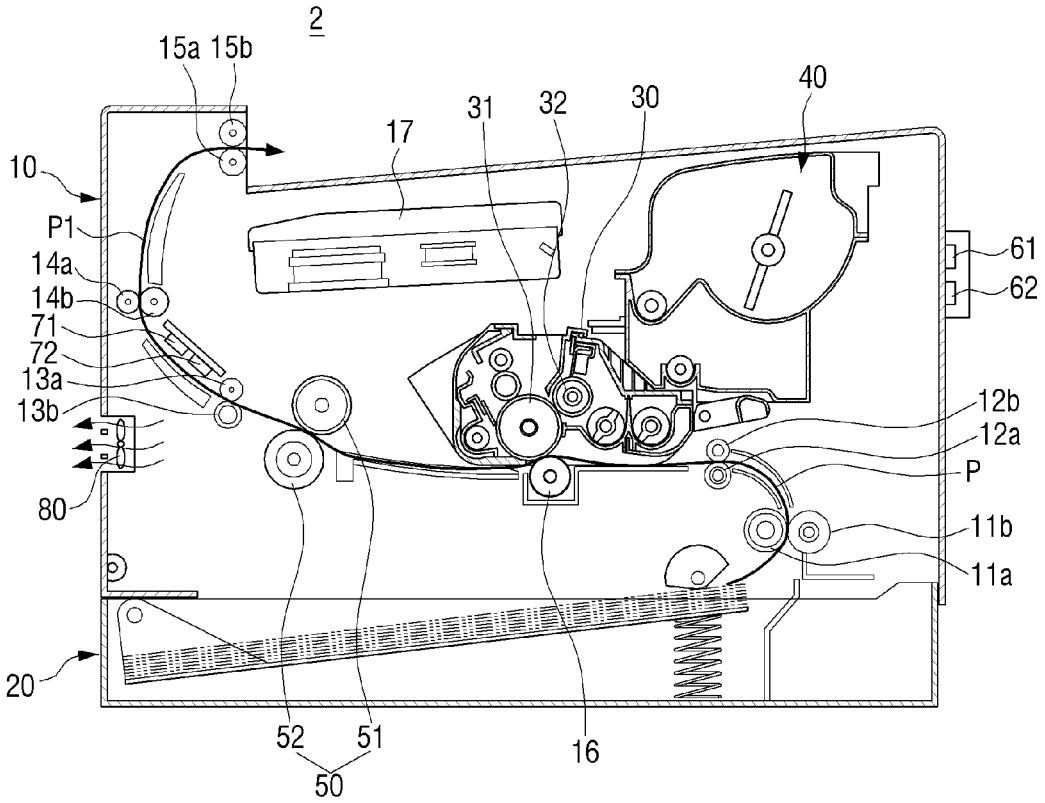
FIG. 7 is a view illustrating an alternative arrangement of a second temperature sensor and a second humidity sensor provided in the image forming apparatus of FIG. 5.

FIG. 5 is a view schematically illustrating an image forming apparatus 2 according to an exemplary embodiment of the present general inventive concept, and FIG. 6 is a block diagram illustrating a configuration provided in the image forming apparatus 2 of FIG. 5 in order to prevent dew condensation. FIG. 7 is a view illustrating an alternative arrangement of a second temperature sensor 71 and a second humidity sensor 72 provided in the image forming apparatus 2 of FIG. 5.

The image forming apparatus 2 according to the exemplary embodiment of the present general inventive concept is similar to the image forming apparatus 1 according to the exemplary embodiment of the present general inventive concept as described above with reference to FIGS. 1-4. However, as illustrated in FIGS. 5 and 6, the image forming apparatus 2 is distinct from the above-described image forming apparatus 1 having only the first humidity sensor 62 to measure the outside humidity at the point in which the image forming apparatus 2 is provided with the first humidity sensor 62 to measure the outside humidity and a second humidity sensor 72 to measure the inside humidity.

As illustrated in FIG. 5, the second humidity sensor 72 is disposed above and adjacent to the fusing unit 50. For the purposes of this exemplary embodiment, relative terms such as "above" and "below" are made with reference to FIGS. 5 and 7. The second humidity sensor 72 may be disposed in a level higher than the nip which is formed between the heat roller 51 and the pressure roller 52. Alternatively, as illustrated in FIG. 7, the second humidity sensor 72 may be disposed adjacent to the portion P1 of the paper conveying path P which is disposed downstream of the fusing unit 50. The second humidity sensor 72 measures the humidity of the inside of the image forming apparatus 2. The measured inside humidity is transmitted to the controller 90.

Like the controller 90 of the aforementioned image forming apparatus 1, in the image forming apparatus 2, the controller 90 controls the operation of the fan 80 in order to prevent the occurrence of the dew condensation inside the image forming apparatus 2. However, unlike the controller 90 of the aforementioned image forming apparatus 1, which uses the outside humidity measured by the first humidity sensor 62, the controller 90 of the image forming apparatus 2 uses the inside humidity measured by the second humidity sensor 72.

Figure 8:
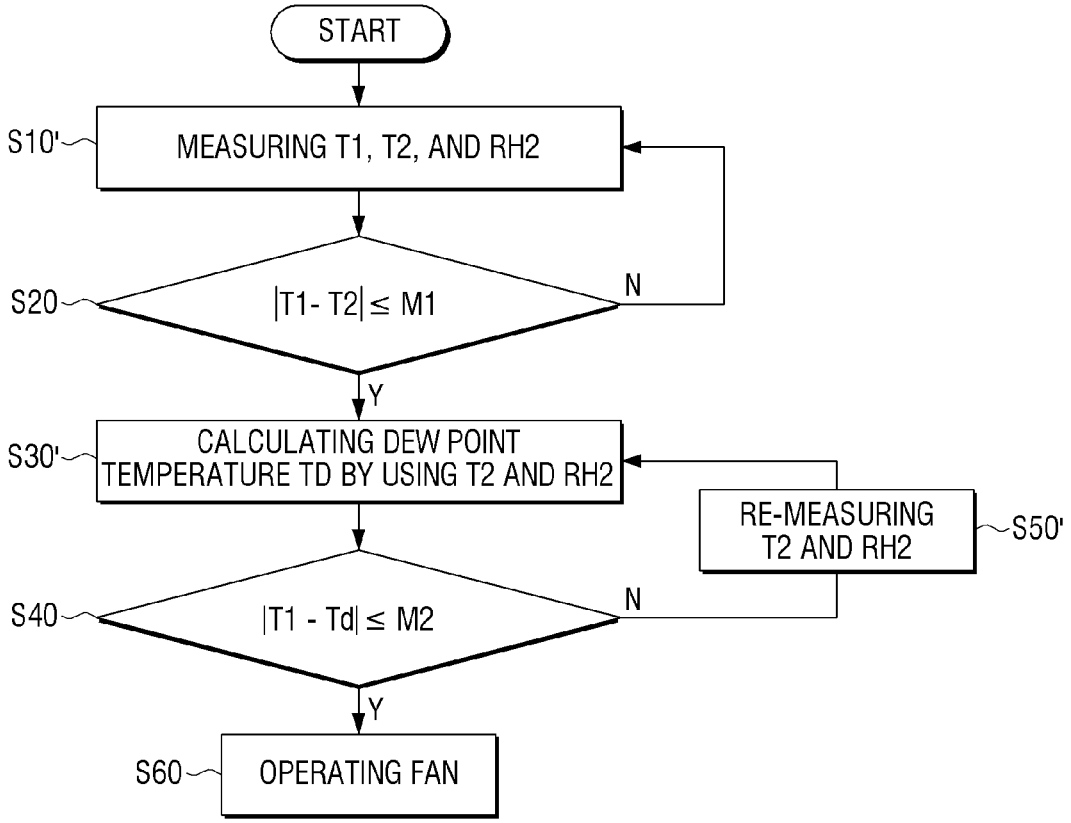
FIG. 8 is a flowchart illustrating a control of an operation of a fan that is performed by a controller of the image forming apparatus of FIG. 5.

The control of the operation of the fan which is performed by the controller 90 of the image forming apparatus 2 will be explained in detail with reference to FIG. 8. Here, FIG. 8 is a flowchart illustrating a control of an operation of a fan that is performed by a controller of the image forming apparatus of FIG. 5.

In an operation S10', the first temperature sensor 61, the second temperature sensor 71, and the second humidity sensor 72 measure outside temperature T1, inside temperature T2, and inside humidity RH2, respectively.

In the operation S20, difference between the outside temperature T1 and the inside temperature T2 (|T1−T2|) is compared to the preset first temperature margin M1. If the difference is equal to or less than the first temperature margin M1 (operation S20-Y), a next operation S30' is performed, and if the difference is larger than the first temperature margin M1 (operation S20-N), the process returns to the operation S10'. For example, the first temperature margin M1 may be set in the range of 3° C. or less.

In the operation S30', a dew point temperature Td is calculated by substituting the measured inside temperature T2 and the measured inside humidity RH2 into a dew point calculation formula. The above-described Magnus formula may be used as the dew point calculation formula.

The operation S30' is distinct from the aforementioned operation S30 of FIG. 4 which substitutes the outside humidity RH1 into the dew point calculation formula at the point in which the operation S30' substitutes the inside humidity RH2 into the dew point calculation formula. Because the operation S30' is an operation to calculate the dew point temperature of high-temperature inside air formed around the fusing unit 50, in order to calculate the accurate dew point temperature, the inside humidity RH2 is preferably substituted into the dew point calculation formula. However, when considering that further providing the second humidity sensor 72 to the image forming apparatus 2 is accompanied by increase in cost, that, as in the aforementioned image forming apparatus 1, using the outside humidity RH1 instead of the inside humidity RH2 in the dew point calculation formula, as in the image forming apparatus 1, is advantageous in terms of cost. Alternatively, the first humidity sensor 62 may be omitted entirely in the interests of simplifying construction and saving cost, and the second humidity sensor 72 may be maintained to measure the inside humidity RH2 and thereby calculate the dew point temperature Td.

In the operation S40, the outside temperature T1 measured in the operation S10' is compared to the dew point temperature Td calculated in the operation S30'. As a result of the comparison, if it is determined that the difference between the outside temperature T1 and the dew point temperature Td (|T1−Td|) is greater than the second temperature margin M2 (S40-N), it performs an operation S50' in which the inside temperature T2 and the inside humidity RH2 are re-measured, and then returns to the operation S30'. As a result of the comparison, if it is determined that the difference between the outside temperature T1 and the dew point temperature Td is equal to or less than the second temperature margin M2 (S40-Y), the next operation S60 to prevent the dew condensation in advance is performed.

In the operation S60, the fan 80 is operated to suppress the rise of the inside temperature T2. If the fan 80 is operated, the air around the fusing unit 50 is cooled so that the rise of the inside temperature T2 that indicates the temperature around the fusing unit 50 is suppressed. As a result, the rise of the dew point temperature Td is also suppressed so that the dew point temperature Td is prevented from reaching the outside temperature T1. When considering the fact that, when the dew point temperature Td and the outside temperature T1 are equal, the dew condensation occurs, it can be understood that the occurrence of the dew condensation in the image forming apparatus 2 is prevented in advance by operating the fan 80 in the operation S60.

As described above, with the image forming apparatus 2 according to the exemplary embodiment of the present general inventive concept, since the occurrence of the dew condensation is prevented in advance by predicting the likelihood that the dew condensation will occur inside the image forming apparatus 2, the phenomenon in which dew formed on the parts (e.g., the conveying rollers 11*a*-14*b* or the paper discharging rollers 15*a*, 15*b*) inside the image forming apparatus 2 is stuck onto and discharged with the print medium may be prevented. Accordingly, it can be prevented that print quality is degraded due to the occurrence of the dew condensation in the image forming apparatus 2.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus comprising:

a main body having a fusing unit;

a first temperature sensor which is disposed in an external surface of the main body and measures an outside temperature;

a humidity sensor which is disposed in the external surface of the main body and measures an outside humidity;

a second temperature sensor which is disposed inside the main body and measures an inside temperature;

at least one fan disposed in the main body; and a controller configured to calculate a dew point temperature by using the inside temperature and the outside humidity and operate the at least one fan based on the calculated dew point temperature, wherein the controller compares a temperature difference between the outside temperature and the inside temperature to a preset temperature margin, and, if the temperature difference is equal to or less than the preset temperature margin, the controller calculates the dew point temperature.

2. The image forming apparatus of claim 1, wherein the controller compares the outside temperature to the dew point temperature, and, if a difference between the outside temperature and the dew point temperature is equal to or less than the preset temperature margin, the controller operates the at least one fan.

3. The image forming apparatus of claim 1, wherein the preset temperature margin is 3° C. or more.

4. The image forming apparatus of claim 1, wherein the second temperature sensor is disposed above the fusing unit.

5. The image forming apparatus of claim 1, wherein the second temperature sensor is disposed adjacent to a portion of a paper conveying path which is disposed downstream of the fusing unit.

6. The image forming apparatus of claim 1, wherein the controller calculates the dew point temperature by using a Magnus formula.

7. An image forming apparatus comprising:

a main body having a fusing unit;

a first temperature sensor which is disposed in an external surface of the main body and measures an outside temperature;

a second temperature sensor which is disposed inside the main body and measures an inside temperature;

a humidity sensor which is disposed inside the main body and measures an inside humidity;

at least one fan disposed in the main body; and a controller configured to calculate a dew point temperature by using the inside temperature and the inside humidity and operate the at least one fan based on the calculated dew point temperature, wherein the controller compares a temperature difference between the outside temperature and the inside temperature to a preset temperature margin, and, if the temperature difference is equal to or less than the preset temperature margin, the controller calculates the dew point temperature.

8. The image forming apparatus of claim 7, wherein the controller compares the outside temperature to the dew point temperature, and, if a difference between the outside temperature and the dew point temperature is equal to or less than the preset temperature margin, the controller operates the at least one fan.

9. The image forming apparatus of claim 7, wherein the preset temperature margin is 3° C. or more.

10. The image forming apparatus of claim 7, wherein the second temperature sensor and the humidity sensor are disposed above the fusing unit.

11. The image forming apparatus of claim 7, wherein the second temperature sensor and the humidity sensor are disposed adjacent to a portion of a paper conveying path which is disposed downstream of the fusing unit.

12. An image forming apparatus comprising:

a main body;

a first temperature sensor to measure an outside temperature corresponding to an air temperature outside of the main body;

a humidity sensor to measure a humidity;

a second temperature sensor to measure an inside temperature corresponding to an air temperature inside of the main body;

a cooling unit disposed in the main body; and a controller configured to calculate a dew point temperature by using the inside temperature and the humidity, and to operate the cooling unit based on a difference between the outside temperature and the calculated dew point temperature.

13. The image forming apparatus of claim 12, wherein the controller calculates the dew point temperature when a difference between the inside temperature and the outside temperature is less than or equal to a first predetermined temperature margin.

14. The image forming apparatus of claim 13, wherein the controller operates the cooling unit if the difference between the outside temperature and the calculated dew point temperature is less than or equal to a second predetermined temperature margin.

15. An image forming apparatus comprising:

a main body having a fusing unit;

a first temperature sensor which is disposed in an external surface of the main body and measures an outside temperature;

a humidity sensor which is disposed in the external surface of the main body and measures an outside humidity;

a second temperature sensor which is disposed inside the main body and measures an inside temperature;

a fan disposed in the main body; and a controller configured to compare a temperature difference between the measured outside temperature and the measured inside temperature to a first preset temperature margin, and, if the temperature difference is less than or equal to the preset temperature margin, to calculate a dew point temperature using the measured inside temperature and the measured outside humidity, wherein the controller is further configured to operate the fan when a difference between the calculated dew point temperature and the measured outside temperature is less than or equal to a second preset temperature margin.

* * * * *